US009731730B2

(12) United States Patent
Stiles

(10) Patent No.: US 9,731,730 B2
(45) Date of Patent: Aug. 15, 2017

(54) GRATING CONNECTOR AND SPACER APPARATUS, SYSTEM, AND METHODS OF USING THE SAME

(71) Applicant: Holland LP, Crete, IL (US)

(72) Inventor: Alexander Stiles, Park Forest, IL (US)

(73) Assignee: Holland LP, Crete, IL (US)

( * ) Notice: Subject to any disclaimer, the term of this patent is extended or adjusted under 35 U.S.C. 154(b) by 102 days.

(21) Appl. No.: 14/864,328

(22) Filed: Sep. 24, 2015

(65) Prior Publication Data

US 2016/0082981 A1 Mar. 24, 2016

Related U.S. Application Data

(60) Provisional application No. 62/054,432, filed on Sep. 24, 2014.

(51) Int. Cl.
*G01B 5/24* (2006.01)
*B61D 3/18* (2006.01)

(52) U.S. Cl.
CPC ..... *B61D 3/187* (2013.01)

(58) Field of Classification Search
CPC ..... G01B 5/24; G01B 5/25; B61D 3/187
USPC ..... 33/613, 645, 651
See application file for complete search history.

(56) References Cited

U.S. PATENT DOCUMENTS 5,933,975 A * 8/1999 Pate ..... G01B 5/25 33/533
6,219,987 B1 * 4/2001 Trent ..... E04C 2/42 52/676
7,618,221 B2 * 11/2009 Thomson ..... B60P 7/0823 410/155
2006/0010703 A1 * 1/2006 Gauthier ..... E04G 21/1891 33/613

(Continued)

FOREIGN PATENT DOCUMENTS

GB 360865 A 11/1931
GB 1314753 A 4/1973
JP 2007218083 A 8/2007

OTHER PUBLICATIONS

International Search Report and Written Opinion of the International Searching Authority.

*Primary Examiner* — G. Bradley Bennett
(74) *Attorney, Agent, or Firm* — Scherrer Patent & Trademark Law, P.C.; Stephen T. Scherrer; Monique A. Morneault

(57) ABSTRACT

The present invention relates to an apparatus, system, and method of using the same for connecting and spacing grating and the like. Specifically, the present invention relates to connecting and spacing wire gratings, for example wire gratings used as vehicle tire support material or for mounting wheel chocks thereon in the transportation of automobiles. Even more specifically, the present invention may be used to connect a plurality of wire gratings together and to space in a first direction the plurality of gratings apart from (Continued)

each other at multiple selectable distances in one configuration. In a second configuration, the present invention may be used to space in a second direction the plurality of gratings from other objects, such as a wall or guard rail. The second configuration may be used in multiple orientations in order to provide multiple different spacing distances.

20 Claims, 6 Drawing Sheets

(56) References Cited

U.S. PATENT DOCUMENTS

| | | | | |
|---|---|---|---|---|
| 2010/0083519 | A1* | 4/2010 | Bradley | E04G 21/1841 33/613 |
| 2013/0219732 | A1* | 8/2013 | Jordan | E04G 21/1891 33/613 |
| 2014/0305888 | A1* | 10/2014 | Nales | A47G 19/08 211/41.2 |
| 2015/0291182 | A1* | 10/2015 | Stiles | B61D 45/008 105/355 |
| 2016/0060883 | A1* | 3/2016 | Fetterman | E04F 21/1855 52/747.1 |

* cited by examiner

FIG. 1
— PRIOR ART —
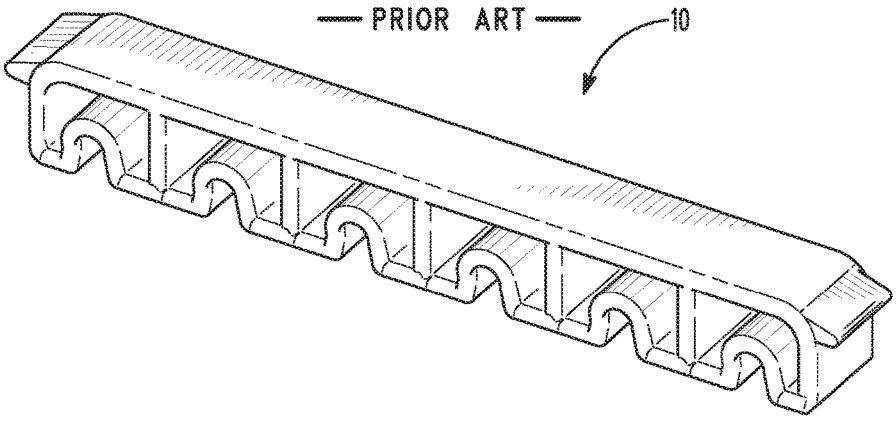
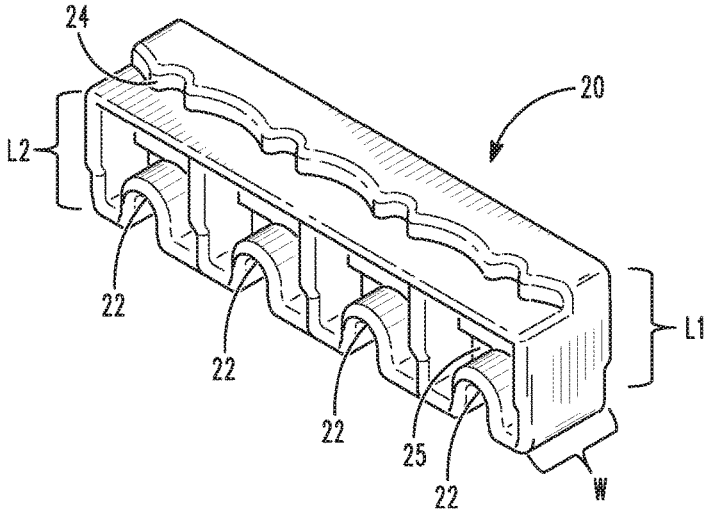
FIG. 2
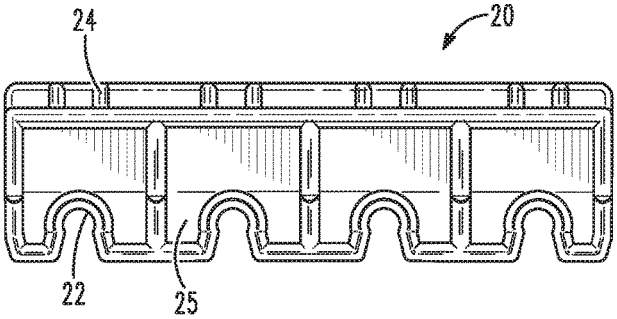
FIG. 3

GRATING CONNECTOR AND SPACER APPARATUS, SYSTEM, AND METHODS OF USING THE SAME

The present invention claims priority to U.S. Provisional Pat. App. No. 62/054,432, titled "Grating Connector and Spacer Apparatus, System, and Methods of Using the Same," filed Sep. 24, 2014, which is hereby incorporated by reference in its entirety.

TECHNICAL FIELD

The present invention relates to an apparatus, system, and method of using the same for connecting and spacing grating and the like. Specifically, the present invention relates to connecting and spacing wire gratings, for example wire gratings used as vehicle tire support material or for mounting wheel chocks thereon in the transportation of automobiles. Even more specifically, the present invention may be used to connect a plurality of wire gratings together and to space in a first direction the plurality of gratings apart from each other at multiple selectable distances in one configuration. In a second configuration, the present invention may be used to space in a second direction the plurality of gratings from other objects, such as a wall or vehicle tire guide.

BACKGROUND

Large vehicles and other large items often must be transported over great distances. Typically, this is done via automobiles, trains, boats, planes, and other transportation devices. No matter the transport method, the large vehicles being transported need to be secured so that shifting does not occur during travel. Vehicles are commonly secured to walls, floors, ceilings, or other supporting structures available on a transportation device.

Vehicles, such as semi-trailer trucks, are frequently used to transport other vehicles, such as automobiles. Semi-trailer trucks may pull open or closed trailers in which cargo and other large goods may be placed thereon or therein. Railway cars are similarly used to transport cargo and other large goods. Sometimes, trailers or railcars are uniquely shaped to aid in the transport of a number of goods. For example, a limited number of vehicles may be transported on or within non-unique trailers or railcars. That limited number may be increased when using uniquely shaped transportation device, such as a car carrier trailer or an auto rack railcar, which are uniquely constructed to transport a large number of automobiles via truck and train respectively.

Railway cars, semi-trailer trucks, and/or car carriers often have wire, mesh, or other types of attaching surfaces to aid in both loading and securing large devices therein or thereon, such as by attaching, tying, strapping, or chocking the large devices to the surface. Sometimes attaching surfaces are built in, especially when using a uniquely constructed transportation device like the car carrier trailer or auto rack railcar previously mentioned. Other times, however, no attaching surfaces are built in transportation devices. In these cases, attaching surfaces must be added in order to transport and secure vehicles thereon.

Installing attaching surfaces can be troublesome because not every transportation device is identical. Transportation devices often have ramps, wheel wells, struts, chains, grooves, uneven floor boards, and the like. A need, therefore, exists for an apparatus, system, and method of using the same for installing attaching surfaces on multiple transportation devices and across varying surfaces.

Commonly, while installing attaching surfaces it is difficult to maintain length spacing throughout the transportation device. One way to ensure correct length spacing is to install an attaching surface having a long pre-defined shape, such as a rectangular surface, parallelogram surface, or the like. However, if the transportation device has varying heights, inclines, or other interferences, using a long predefined shape is difficult. Additionally, a predefined shape will not fit all transportation devices. A need exists for a disjointed apparatus, system, and method of using the same that can vary in length and adjust to changes in length, height or incline.

Disjointed apparatuses and systems, however, are notoriously difficult to maintain in alignment. For example, a small deviation in aligning a second portion with a first portion can subsequently affect the alignment of all additional portions. Sometimes, a grating shoe, such as the prior art grating shoe shown in FIG. 1 produced by Holden America Inc., is used to connect multiple gratings together. However, the grating shoe produced by Holden America Inc. is not versatile. Because of its design, it is difficult or incapable of being used with large inclines or changes in height. The grating shoe is often used for the singular purpose of connecting multiple gratings together. A need exists for a versatile apparatus, system, and method of using the same for connecting multiple attaching surfaces, like grating, together at varying inclines and changes in height.

Additionally, any attaching surface may need to be properly spaced within the width of the transportation device. Often, however, attaching surfaces must be strategically positioned to avoid other objects in the transportation device, to avoid extra costs associated with using additional attaching surface, and to avoid a waste of material and/or space. When automobiles are transported, only the tires contact and are chocked to the attaching surface. Therefore, the attaching surface must be properly spaced to match the spacing of the tires on the automobiles so that wheel chocks may be aligned. Moreover, if a wheel chock straddles two separate wire gratings, the spacing on both gratings must remain aligned or the wheel chock will not fit. A need exists for an apparatus, system, and method for properly spacing an attaching surface according to the dimensions of the device or vehicle being transported and the width of the transportation device

SUMMARY OF THE INVENTION

The present invention relates to an apparatus, system, and method of using the same for connecting and spacing grating and the like. Specifically, the present invention relates to connecting and spacing wire gratings, for example wire gratings used as vehicle tire support material or for mounting wheel chocks thereon in the transportation of automobiles. Even more specifically, the present invention may be used to connect a plurality of wire gratings together and to space in a first direction the plurality of gratings apart from each other at multiple selectable distances in one configuration. In a second configuration, the present invention may be used to space in a second direction the plurality of gratings from other objects, such as a wall or vehicle tire guide.

To this end, in an embodiment of the present invention, an apparatus is provided. The apparatus comprises a main body portion having a first side and a second side; a plurality of cavities disposed on the first side of the main body portion dimensioned to fit a first side of an attaching wire grating surface in a first configuration; and a plurality of ridges disposed on the second side of the main body portion dimensioned to fit a second side of an attaching wire grating surface in a second configuration.

In an alternate embodiment of the present invention a system is provided. The system comprises a first apparatus having a main body portion having a first side and a second side; a plurality of cavities disposed on the first side of the main body portion of the first apparatus dimensioned to fit a first side of an attaching wire grating surface in a first configuration; and a plurality of ridges disposed on the second side of the main body portion of the first apparatus dimensioned to fit a second side of an attaching wire grating surface in a second configuration; a second apparatus having a main body portion having a first side and a second side; a plurality of cavities disposed on the first side of the main body portion of the second apparatus dimensioned to fit a first side of an attaching wire grating surface in a first configuration; and a plurality of ridges disposed on the second side of the main body portion of the second apparatus dimensioned to fit a second side of an attaching wire grating surface in a second configuration; a first attaching wire grating surface; and a second attaching wire grating surface.

In an alternate embodiment of the present invention a method is provided. The method comprises the steps of providing a first apparatus having a main body portion having a first side and a second side; a plurality of cavities disposed on the first side of the main body portion of the first apparatus dimensioned to fit a first side of an attaching wire grating surface in a first configuration; and a plurality of ridges disposed on the second side of the main body portion of the first apparatus dimensioned to fit a second side of an attaching wire grating surface in a second configuration; providing a second apparatus having a main body portion having a first side and a second side; a plurality of cavities disposed on the first side of the main body portion of the second apparatus dimensioned to fit a first side of an attaching wire grating surface in a first configuration; and a plurality of ridges disposed on the second side of the main body portion of the second apparatus dimensioned to fit a second side of an attaching wire grating surface in a second configuration; providing a first attaching wire grating surface; providing a second attaching wire grating surface; connecting the first attaching wire grating surface to the second attaching wire grating surface using the plurality of cavities on the first apparatus in the first configuration; and spacing the first attaching wire grating surface from a wall using the plurality of ridges on the second apparatus in the second configuration.

It is, therefore, an advantage and objective of the present invention to provide an apparatus, system, and method of using the same for installing attaching surfaces on multiple transportation devices and across varying surfaces.

It is an advantage and objective of the present invention to provide a disjointed apparatus, system, and method of using the same that can vary in length and adjust to changes in height or incline.

It is an advantage and objective of the present invention to provide a versatile apparatus, system, and method of using the same for connecting multiple attaching surfaces, like grating, together at varying inclines and changes in height.

It is an advantage and objective of the present invention to provide an apparatus, system, and method for properly spacing attaching surface according to the device being transported and the width of the transportation device.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

FIG. 1 illustrates a perspective view of a grating shoe used to connect multiple gratings together.

FIG. 2 illustrates a perspective view of a spacing and connecting apparatus in an embodiment of the present invention.

FIG. 3 illustrates a front view of a spacing and connecting apparatus in a first configuration in an embodiment of the present invention.

DETAILED DESCRIPTION OF THE PRESENTLY PREFERRED EMBODIMENTS

Figure 4:
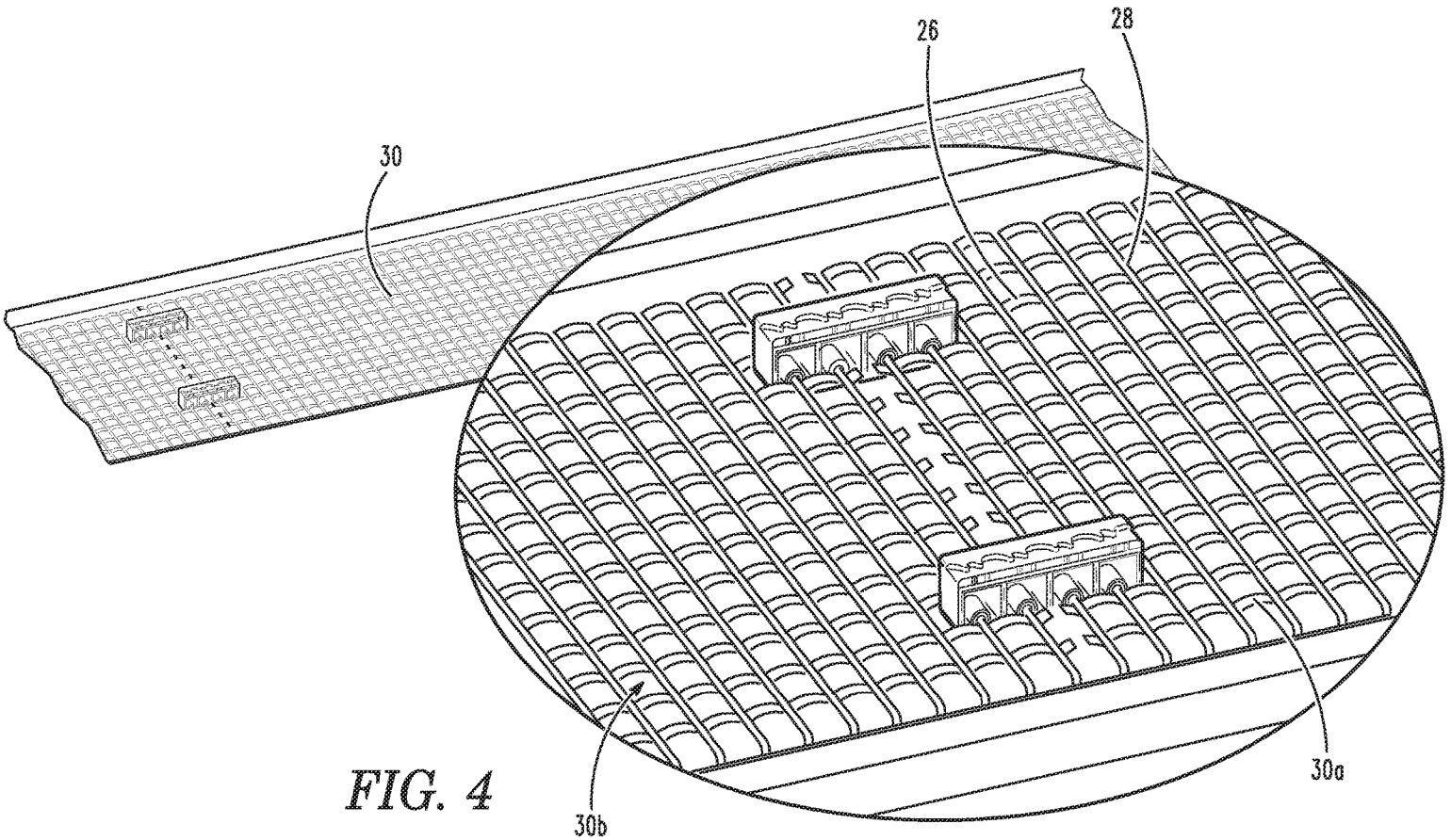
FIG. 4 illustrates a perspective view of a spacing and connecting apparatus in a first configuration connecting multiple attaching surfaces in an embodiment of the present invention.

The present invention relates to an apparatus, system, and method of using the same for connecting and spacing grating and the like. Specifically, the present invention relates to connecting and spacing wire gratings, for example wire gratings used as vehicle tire support material or for mounting wheel chocks thereon in the transportation of automobiles in, for example, an auto rack railcar. Even more specifically, the present invention may be used to connect a plurality of wire gratings together and to space in a first direction the plurality of gratings apart from each other at multiple selectable distances in one configuration. In a second configuration, the present invention may be used to space in a second direction the plurality of gratings from other objects, such as a wall or tire guide.

Now referring to the figures, wherein like numerals refer to like parts, FIG. 1 illustrates, a grating shoe 10, produced by Holden America Inc. The grating shoe 10 serves the singular purpose of connecting multiple pieces of grating together. FIG. 2 illustrates an improved spacing and connecting apparatus 20 of the present invention, The spacing and connecting apparatus 20 may be used in multiple configurations to connect multiple attaching surfaces together and to space attaching surfaces from walls, interferences, or other structures. Specifically, a plurality of cavities 22 may be disposed on a bottom side of the spacing and connecting apparatus 20 and a plurality of ridges 24 may be disposed on a top side of the spacing and connecting apparatus 20. As shown in FIG. 2, the plurality of cavities 22 may face downward while the plurality of ridges 24 may face ninety degrees away from the plurality of cavities 22. This may allow the spacing and connecting apparatus 20 to be used in a first configuration, with the plurality of cavities 22 facing downwardly towards and subsequently connected to a first side of an attaching surface, and in a second configuration, by rotating the spacing and connecting apparatus 20 ninety degrees such that the plurality of ridges 24 are facing towards and subsequently are disposed adjacent to a second side of the attaching surface.

Specifically, the spacing and connecting apparatus 20 may be used in the second configuration in different orientations to provide multiple spacing distances, as determined by a user. The spacing and connecting apparatus 20 may be used in the second configuration in a first orientation wherein the plurality of ridges 24 may be disposed next to the second side of the attaching surface and may space the second side of the attaching surface 1.75 inches away from a wall, interference, or other structure. The spacing and connecting apparatus 20 may be used in the second configuration in a second orientation wherein the plurality of ridges 24 may be disposed above and may rest on top of the second side of the attaching surface. Preferably, the first orientation may provide a spacing of 1.5 inches away from a wall, interference, or other structure.

As further shown in FIG. 2, the spacing and connecting apparatus 20 may have a sufficient width W that may ensure a secure hold when the plurality of cavities 22 connect to an attaching surface, as further discussed below. Additionally, the spacing and connecting apparatus 20 may have a sufficient length L1 between a bottom of the spacing and connecting apparatus 20 and an end of the plurality of ridges 24, such that the spacing and connecting apparatus 20 may space an attaching surface a distance L1 away from any walls, interferences, or other structures, as further discussed below. Additionally, the spacing and connecting apparatus 20 may have a second length L2 between the bottom of the spacing and connecting apparatus 20 and a beginning of the plurality of ridges, such that the spacing and connecting apparatus 20 may space an attaching surface a distance L2 away from any walls, interferences, or other structures. As discussed above, L1 may preferably be 1.75 inches and L2 may be 1.5 inches, but may be any lengths without departing from the scope of the present invention. In one embodiment, a plurality of openings 25 may be disposed within the spacing and connecting apparatus 20 in order to save material. The spacing and connecting apparatus 20 may be made of metal, polymer, fiber reinforced polymer, or other like material known to those skilled in the art. The spacing and connecting apparatus 20 may be shaped, molded, 3D printed, or created by other forming methods known to those skilled in the art.

In the first configuration, further shown in FIGS. 3-6, the plurality of cavities 22 may accept the first side of at least one attaching surface. In one embodiment, the at least one attaching surface may comprise a plurality of waved bars 26 in a first dimension and a plurality of straight bars 28 in a second dimension, which may form a plurality of mesh grids 30. The plurality of straight bars 28 in the second dimension may be attached, such as by spot welding, to the plurality of waved bars 26 in the first dimension. In this embodiment, the spacing and connecting apparatus 20 may be placed between the plurality of waved bars in the first dimension 26. The spacing and connecting apparatus 20 may connect directly to the straight bars 28 in the second dimension via the plurality of cavities 22 by applying force at or near the top of the spacing and connecting apparatus 20 downwardly towards the plurality of mesh grids 30. In an alternate embodiment, the at least one attaching surface may comprise a plurality of interwoven bars that may form an interwoven mesh grid, which may not require any welding to be held together, such as the interwoven mesh grid disclosed in U.S. Provisional Pat. App. No. 61/932,062, which is incorporated by reference herein it its entirety.

In a preferred embodiment wherein the spacing and connecting apparatus 20 has four cavities 22, the spacing and connecting apparatus 20 may connect two mesh grids 30 by connecting two of the plurality of straight bars in the second dimension 28 from a first mesh grid 30*a* in two of the cavities 22 and two of the plurality of straight bars in the second dimension 28 from a second mesh grid 30*b* in the other two cavities 22. Preferably, any gaps between mesh grids 30 in the same plane may maintain the same spacing as between the plurality of straight bars in the second dimension 28. In a preferred embodiment, this spacing may be 1.5 inches. Thus, in one embodiment, the plurality of cavities 22 may be equally spaced apart and in a preferred embodiment, the plurality of cavities 22 may be equally spaced 1.5 inches apart.

Alternatively, one cavity 22 may accept one of the plurality of straight bars in the second dimension 28 from the first mesh grid 30*a* and the other three cavities 22 may accept three of the plurality of straight bars in the second dimension 28 from the first mesh grid 30*b*. In another alternate embodiment, one cavity 22 may accept one of the plurality of straight bars in the second dimension 28 from the first mesh grid 30*a* and one other cavities 22 may accept one of the plurality of straight bars in the second dimension 28 from the first mesh grid 30*b*, leaving two cavities empty, as shown further in FIG. 6. Additionally, in another alternate embodiment, one cavity 22 may accept one of the plurality of straight bars in the second dimension 28 from the first mesh grid 30*a* and two other cavities 22 may accept two of the plurality of straight bars in the second dimension 28 from the first mesh grid 30*b*, leaving one cavity empty, as shown further in FIG. 5. Of course, many other different alternative embodiments may be utilized and those mentioned herein are used to demonstrate and not to limit.

Figure 5:
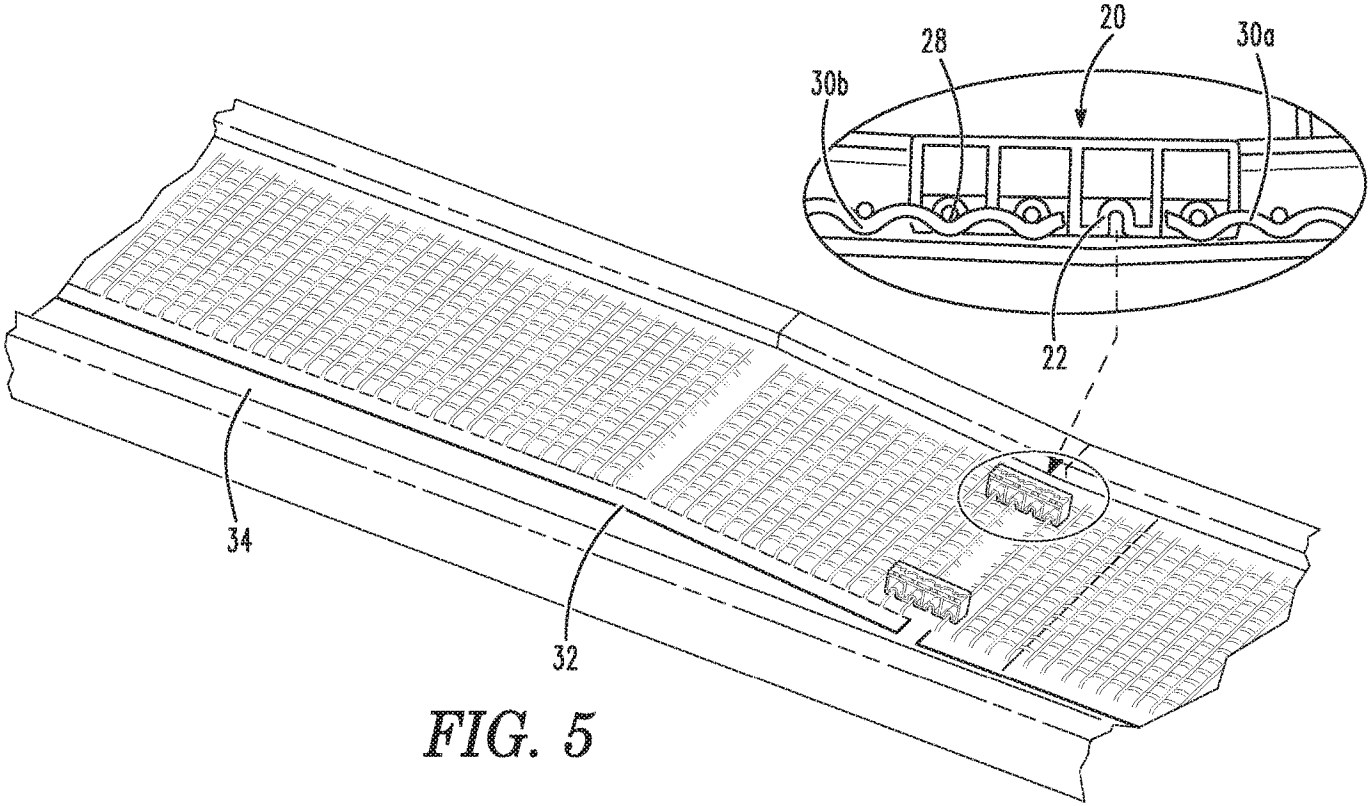
FIG. 5 illustrates a perspective view of a spacing and connecting apparatus in a first configuration connecting multiple attaching surfaces on an incline in an embodiment of the present invention.
Figure 6:
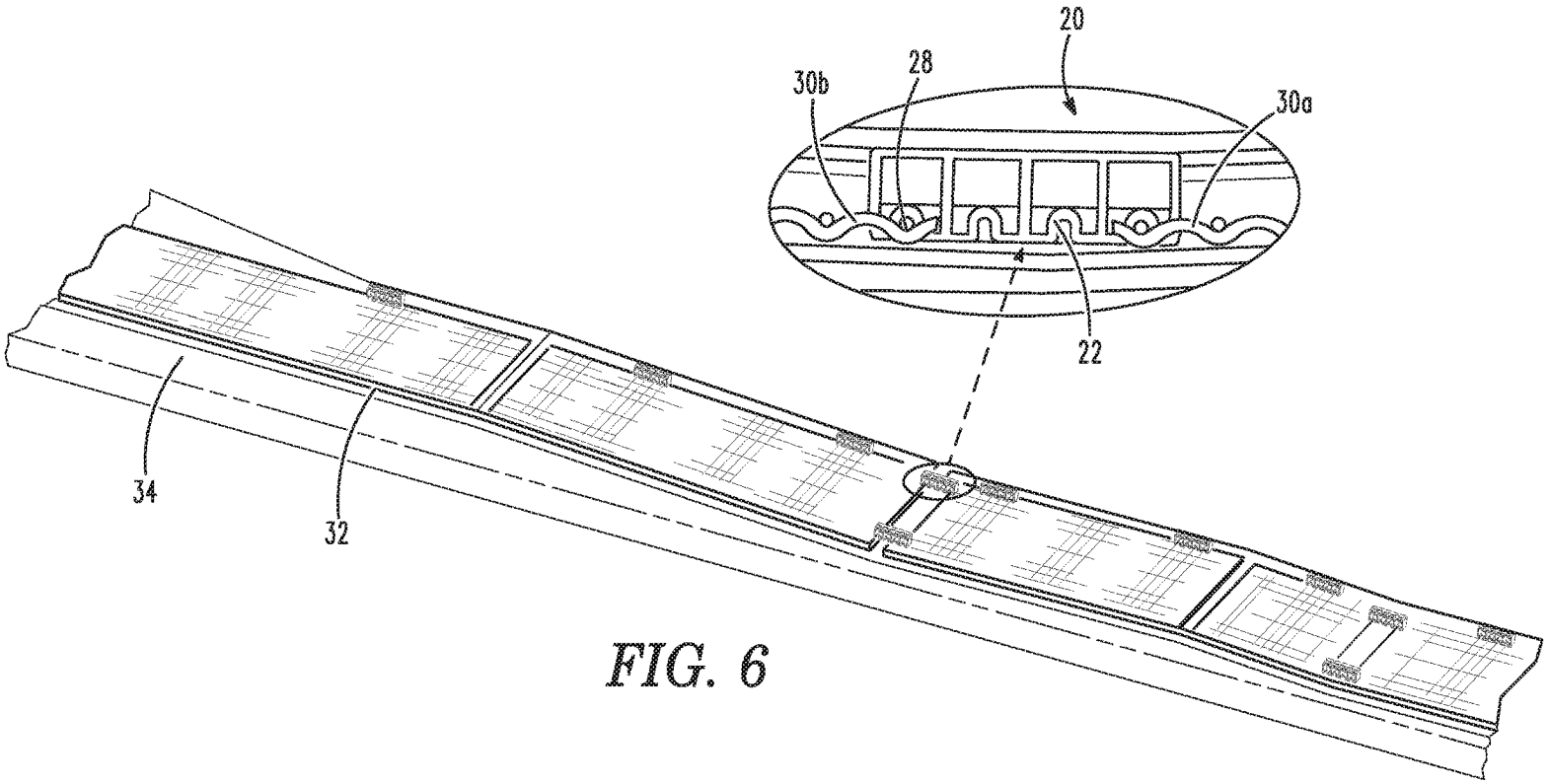
FIG. 6 illustrates a perspective view of a spacing and connecting apparatus in a first configuration connecting multiple attaching surfaces on an incline in an embodiment of the present invention.

In an embodiment wherein one or more cavities 22 are empty while still connecting one or more mesh grids 30, the one or more mesh grids 30 may be on different planes, inclines, or other changes in height. In an embodiment exemplified in FIGS. 5-6, having one or more mesh grids or gratings fit an overall length of an auto rack railcar may be addressed by using different numbers of cavities 22 to connect to the plurality of straight bars in the second dimension 28. Specifically, as shown in FIG. 5, an incline may be bridged by leaving one cavity 22 empty. As shown in FIG. 6, the incline alternatively may be bridged by leaving two cavities 22 empty ensuring that the mesh grids or gratings sufficiently traverse the overall length of the auto rack railcar.

As further shown in FIGS. 5-6, the present invention may be used concurrently with a plurality of hinged bases 32. The plurality of hinged bases 32 may be disposed on a third side of the attaching surface, or mesh grids 30 as shown in FIGS. 5-6. The spacing and connecting apparatus 20 may not be necessary, at least in its first configuration, where the plurality of hinged bases 32 connect multiple attaching surfaces, or mesh grids 30, together. However, the spacing and connection apparatus 20 may be necessary if a gap between multiple attaching surfaces becomes narrower or wider opposite the hinged bases 32, which may make attachment of an object, such as a chock, difficult or impossible.

The spacing and connection apparatus 20 may be used in order to better secure together the multiple attaching surfaces, or mesh grids 30. The plurality of hinged bases 32 also may be used to secure the attaching surface, or mesh grids 30, to a surface 34 therebelow. Before the attaching surface, or mesh grids 30, can be secured, they must be properly spaced.

Figure 7:
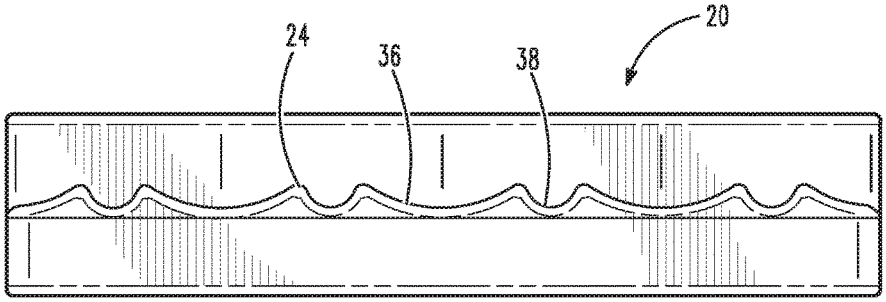
FIG. 7 illustrates a front view of a spacing and connecting apparatus in a first orientation of a second configuration in an embodiment of the present invention.
Figure 8:
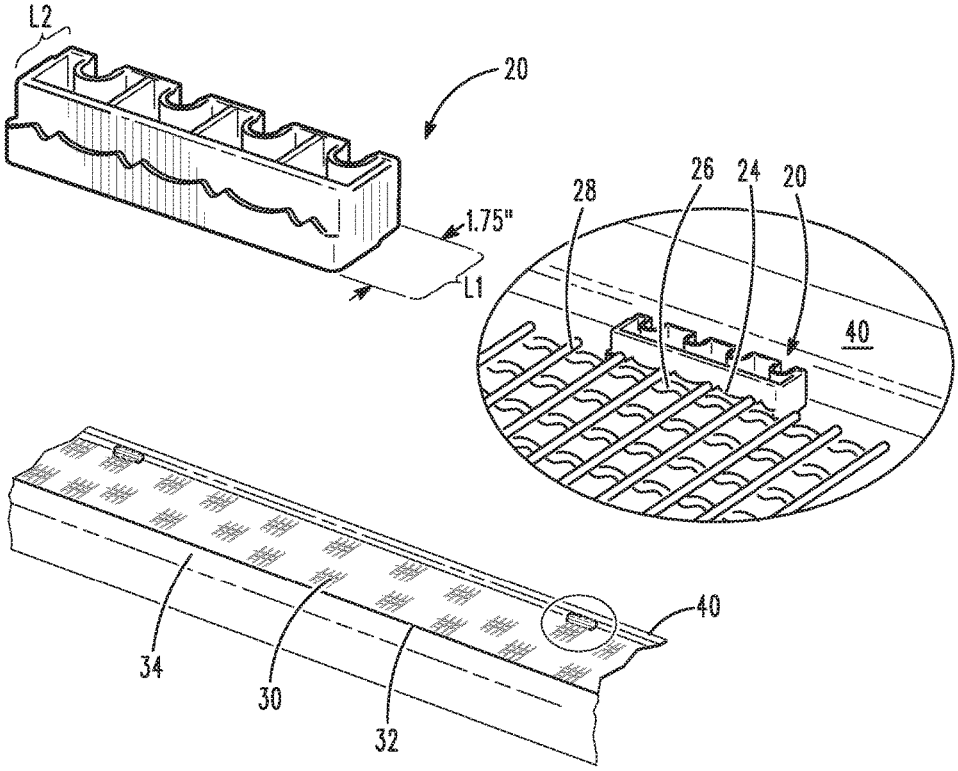
FIG. 8 illustrates a perspective view of a spacing and connecting apparatus in a first orientation of a second configuration used to space an attaching surface a distance from a wall in an embodiment of the present invention.

FIGS. 4-6 show that a plurality of spacing and connecting apparatuses 20 may be used concurrently in both the first and second configuration. In the second configuration, as further detailed in FIGS. 7-8, the plurality of ridges 24 of the spacing and connecting apparatus 20 may be disposed adjacent a second side of at least one attaching surface. As shown in FIG. 8, in a first orientation, an end of the plurality of ridges 24 may rest against the at least one attaching surface to space the same away from a wall, interference, or other structure. As shown in FIG. 7, the plurality of ridges 24 may be facing upwards in the second configuration in the first orientation such that the second side of the at least one attaching surface rests next to the plurality of ridges 24. In an embodiment, the second configuration in the first orientation may space the at least one attaching surface a distance L1 away from a wall, interference, or other structure. Preferably, the distance L1 may be 1.75 inches, but may be any length without departing from the scope of the present invention.

Figure 9:
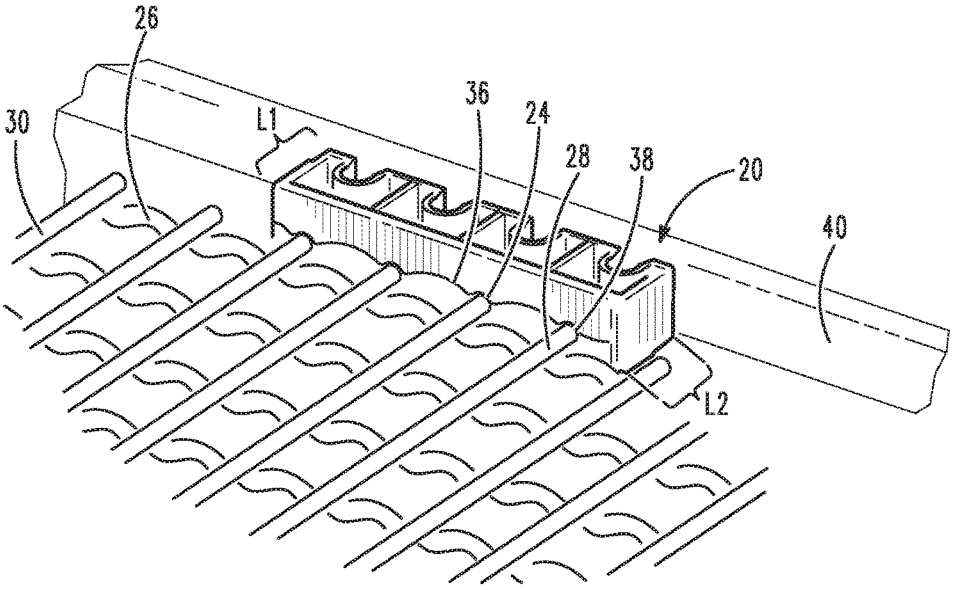
FIG. 9 illustrates a perspective view of a spacing and connecting apparatus in a second orientation of a second configuration but oriented to provide a receiving surface for an attaching surface, such as a grating, a distance from a wall in an embodiment of the present invention.

In one embodiment, the at least one attaching surface may comprise a plurality of waved metal bars in a first dimension 26 and a plurality of straight bars in a second dimension 28, which may form a plurality of mesh grids 30. In a second orientation, the spacing and connecting apparatus 20 may be rotated such that a plurality of elongated recessions 36 may rest on the waved metal in the first dimension 26 and the straight bars in the second dimension 28 may terminate within a plurality of short recessions 38, as shown in FIG. 9. Of course, in alternate embodiments, the plurality of ridges 24 may conform to alternate attaching surfaces, designs, grids, or the like. In an embodiment, the second orientation of the second configuration may space the at least one attaching surface a distance L2 away from a wall, interference, or other structure. Preferably, the distance L2 may be 1.5 inches, but may be any length without departing from the scope of the present invention.

As shown in FIG. 8, the spacing and connecting apparatus 20 may be disposed between a wall 40 and the plurality of mesh grids 30. The second side of the plurality of mesh grids 30 may be disposed adjacent the plurality of ridges 24, as previously described. Specifically, the plurality of mesh grids 30 and the spacing and connecting apparatus 20 in the second configuration in the first orientation may be pushed against the wall 40, such that the plurality of mesh grids 30 are spaced a distance L1 away from the wall 40.

As shown in FIG. 9, the plurality of mesh grids 30 and the spacing and connecting apparatus 20 in the second configuration in the second orientation may be pushed against the wall 40, such that the plurality of mesh grids 30 are spaced a distance L2 away from the wall 40. The plurality of ridges 24 comprising the elongated recessions 36 and the short recessions 38 may be disposed downwardly and placed over the wire mesh or grating, thereby engaging the straight bars 28 and the waved bars 26 of the mesh grid or grating, thereby holding the spacing and connecting apparatus 20 in place. The plurality of mesh grids 30, or alternate attaching surface in other embodiments, may therefore be properly spaced away from the wall 40. The plurality of mesh grids 30 may then be attached to the surface 34 by screwing, nailing, riveting, bolting, stapling, or other known attaching method known to those skilled in the art through the plurality of hinged bases 32.

Figure 10:
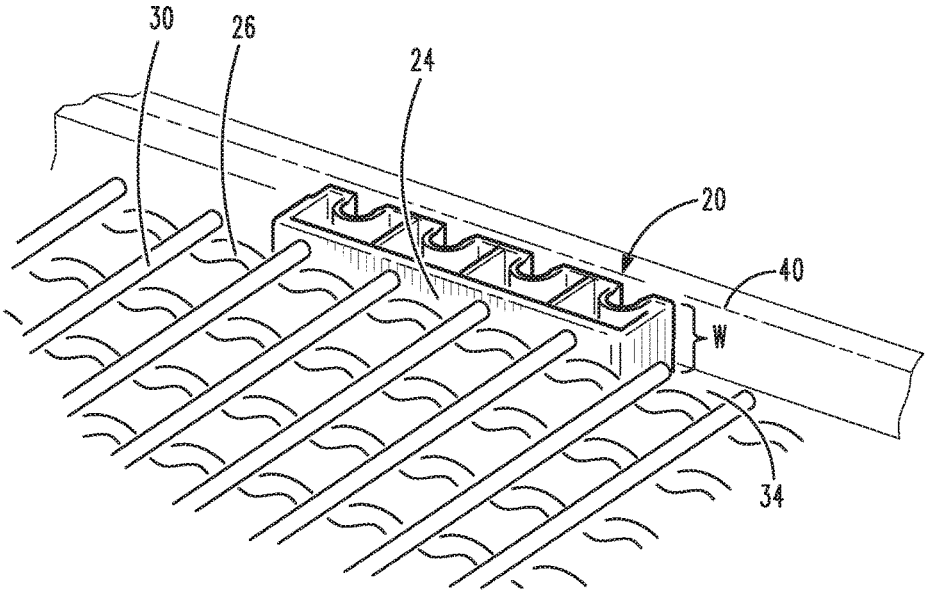
FIG. 10 illustrates a perspective view of a spacing and connection apparatus in a third orientation of a second configuration used to space an attaching surface a distance from a wall when the attaching surface is a height above a surface in an embodiment of the present invention.

Alternatively, the spacing and connecting apparatus 20 may be used in the second configuration in a third orientation, as shown in FIG. 10, wherein the plurality of ridges 24 of the spacing and connecting apparatus 20 may still be facing downwards and may be disposed adjacent the waved metal in the first dimension 26, which may be the case when the plurality of mesh grids 30 are about a distance W above the surface 34 instead of being flush with the surface 34. In an embodiment, the second configuration in the third orientation may space the plurality of mesh grids 30 a distance L1 away from a wall, interference, or other structure and may provide a distance W between the surface 34 and the plurality of mesh grids 30.

While a long flat horizontal mesh grid 30 is shown and described in FIG. 8, disjointed smaller attaching surfaces may be used as described above with the spacing and connecting apparatus 20 used in both the first configuration to connect multiple disjointed smaller attaching surfaces together, and in the second configuration to properly space the multiple disjointed smaller attaching surfaces from the wall 40.

In one embodiment, after a plurality of attaching surfaces has been properly spaced and connected together using a plurality of spacing and connecting apparatuses 20 in multiple configurations, and after securing the plurality of hinged bases 32 to the surface 34, the plurality of spacing and connecting apparatuses 20 may be removed. Subsequently, additional hinged bases 32 may be added to the second side of the plurality of attaching surfaces and may be secured to the surface 34 as described above. In this embodiment, the plurality of attaching surfaces may be secured to the surface 34 on multiple sides, ensuring longevity. In a preferred embodiment, the plurality of attaching surfaces may be attached to the surface 34 by the plurality of hinged bases 32 on one side of the plurality of attaching surfaces. This may allow the plurality of attaching surfaces to be rotated upwards about the hinged bases 32 for cleaning out dirt, oil, and/or other debris that may find its way beneath the plurality of attaching surfaces.

As described herein, a plurality of attaching surfaces may be attached to a surface, such as in an auto rack railcar. In a preferred embodiment of the present invention, the surface 34 may be a tri-level or convertible auto rack A deck comprising a plurality of grating panel assemblies. The grating panel assemblies may be metal gratings having a plurality of grid slots therein. The grating panel assemblies may be attached to the tri-level or convertible auto rack A deck or other surface using apparatuses, systems, and methods as taught by the present invention. First, the grating panel assemblies may attach to a plurality of hinge bases, which may accept the grating panel assemblies thereon. The hinge bases may be connected to the grating panel assemblies adjacent one another, leaving a gap between each hinge base. In one embodiment, the gap may be ⅛ of an inch. Subsequently, hinge caps may be placed over the hinge bases, encapsulating a portion of the grating panel assemblies. In one embodiment, the hinge caps may be staggered over the hinge bases such that one hinge cap overlaps two hinge bases, such as by offsetting the hinge caps approximately 18 inches from the end of a hinge base. In this embodiment, there may be fewer hinge caps than hinge bases, and a portion of the hinge bases may not be covered by a hinge cap.

Next, the grating panel assembly and hinge base/cap combination may be placed on the tri-level or convertible auto rack A deck or other surface. The grating panel assembly and hinge base/cap combination may be spaced a distance away from a wall or guide rail on the tri-level or convertible auto rack A deck or other surface using a spacing and connecting apparatus in the second configuration. The distance may be any pre-determined distance that is appropriate for the circumstances, such as 1.75 inches in one embodiment. As discussed above, the slots of the grating panel assemblies may fit into the plurality of ridges on the spacing and connecting apparatus in the second configuration in the second orientation. The grating panel assembly, hinge base/cap, and spacing and connecting apparatus in the second configuration combination may be pressed against the wall, guide rail, or similar interference to properly space the grating panel assembly.

Additional grating panel assemblies may be placed in series adjacent an initial grating panel assembly, as described above. A plurality of spacing and connecting apparatuses in the first configuration may be used to connect multiple grating panel assemblies together. In one embodiment, two spacing and connecting apparatuses in the first configuration separated by a distance may be used to connect multiple grating panel assemblies together. While the figures and disclosure discuss utilizing the present invention in series, the present invention may alternatively be utilized in parallel. When multiple grating panel assemblies are placed in series, the previously uncovered hinge bases from each grating panel assembly may be covered by a hinge cap, which may completely cover both previously uncovered hinge bases.

This method may be repeated to cover the entire length, or as much length as needed, of the tri-level or convertible auto rack A deck or other surface. Where a change in height or incline is present, a one or two slot gap may be disposed between the grating panel assemblies, which may allow one grating panel assembly to be at a different height or incline than another grating panel assembly. Additionally, a plastic shim may be placed beneath a grating panel assembly and hinge base/cap combination to match the heights of each grating panel assembly.

Once each grating panel assembly is spaced and connected correctly, as described herein, holes may be drilled within the hinge bases and into the tri-level or convertible auto rack A deck or other surface. Rivets, screws, nails, bolts, or other attaching devices may be used to attach the grating panel assembly to the tri-level or convertible auto rack A deck or other surface. In one embodiment, two attaching devices may be used per hinge base/cap to correctly secure. Once attached, the spacing and connecting apparatuses may be removed and a plurality of hinge bases and hinge caps may be similarly installed on an opposite side of the grating panel assembly. Alternatively, the plurality of attaching surfaces, or grating panel assemblies in one embodiment, may be manufactured on the tri-level or convertible auto rack A deck or other surface instead of subsequent installation.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

I claim:

1. A spacer apparatus comprising:

a main body portion having a first side and a second side;

a plurality of cavities disposed on the first side of the main body portion, each cavity configured to fit a laterally extending rod of a wire grating in a first configuration; and a plurality of ridges disposed on the second side of the main body portion, the plurality of ridges configured to fit a longitudinally extending rod having a wave pattern on a wire grating in a second configuration.

2. The spacer apparatus of claim 1 wherein the main body portion is cuboid.

3. The spacer apparatus of claim 1 wherein the plurality of cavities are disposed in the first side of the main body portion.

4. The spacer apparatus of claim 1 wherein the plurality of ridges extends from the second side of the main body portion.

5. The spacer apparatus of claim 1 wherein the main body portion comprises a third side and a fourth side, wherein the first side and the second side are opposite one another.

6. The spacer apparatus of claim 5 wherein each side of the spacer apparatus has a short edge and a long edge, wherein the short edge distance of the third side is longer than the short edge distance of the second side.

7. The spacer apparatus of claim 5 wherein the long edge distance of each side is the same.

8. The spacer apparatus of claim 1 wherein the plurality of ridges comprises a surface having a wave pattern that is configured to match the wave pattern of the longitudinally-extending rod of the wire grating.

9. A system for spacing at least one wire grating in a railcar comprising:

a first wire grating comprising a plurality of straight laterally-extending rods and a plurality of longitudinally-extending rods disposed together in a grid pattern, each longitudinally-extending rod having a wave pattern;

a first spacer apparatus comprising a main body portion having a plurality of cavities disposed on a first side of the main body portion, each cavity configured to fit one of the plurality of straight laterally-extending rods of the first wire grating in a first configuration, and further comprising a plurality of ridges disposed on a second side of the main body portion, the plurality of ridges configured to fit a portion of a first longitudinally-extending rod of the first wire grating in a second configuration, wherein the first spacer apparatus contacts the first wire grating to restrict movement of the first wire grating.

10. The system of claim 9 wherein a first cavity of the first spacer apparatus is disposed on a first straight laterally-extending rod of the wire grating.

11. The system of claim 10 further comprising:

a second wire grating comprising a plurality of straight laterally-extending rods and a plurality of longitudinally-extending rods disposed together in a grid pattern, each longitudinally-extending rod of the second wire grating having a wave pattern, wherein a second cavity of the first spacer apparatus is disposed on a first straight-laterally extending rod of the second wire grating to rigidly hold the first wire grating adjacent to the second wire grating.

12. The system of claim 9 further comprising:

a second wire grating comprising a plurality of straight-laterally extending rods and a plurality of longitudinally-extending rods disposed together in a grid pattern, each longitudinally-extending rod of the second wire grating having a wave pattern, wherein first and second cavities of the first spacer apparatus are disposed on first and second adjacent straight laterally-extending rods of the first wire grating, and further wherein a third cavity of the first spacer apparatus is disposed on a first laterally-extending rod of the second wire grating to rigidly hold the first wire grating adjacent to the second wire grating.

13. The system of claim 12 further comprising:

a fourth cavity of the first spacer apparatus disposed between the second and third cavities of the spacer apparatus, wherein the fourth cavity is not disposed on a laterally-extending rod of the either the first or second wire gratings to provide a space between the first and second adjacent wire gratings.

14. The system of claim 12 further comprising:

a fourth cavity of the spacer apparatus disposed adjacent the third cavity, wherein the fourth cavity is disposed on a second laterally-extending rod of the second wire grating to rigidly hold the first wire grating adjacent to the second wire grating.

15. The system of claim 9 further comprising:

a support surface positioned adjacent the first wire grating and a wall positioned adjacent the support surface, wherein the first spacer apparatus is positioned on the support surface between the wall and the first wire grating.

16. The system of claim 15 wherein a first longitudinally-extending rod of the first wire grating is disposed on the plurality of ridges.

17. The system of claim 16 wherein the plurality of ridges has a wave pattern that matches the wave pattern of the first longitudinally-extending rod.

18. The system of claim 9 further comprising:

a second wire grating comprising a plurality of straight laterally-extending rods and a plurality of longitudinally-extending rods disposed together in a grid pattern, each longitudinally-extending rod having a wave pattern;

a second spacer apparatus comprising a main body portion having a plurality of cavities disposed on the first side of the main body portion, each cavity configured to fit one of the plurality of straight laterally-extending rods of the first wire grating in a first configuration, and further comprising a plurality of ridges disposed on the second side of the main body portion, the plurality of ridges configured to fit a portion of a first longitudinally-extending rod of the first wire grating in a second configuration, wherein a first cavity of the first spacer apparatus is disposed on a first straight laterally-extending rod of the wire grating and further wherein a second cavity of the first spacer apparatus is disposed on a first straight-laterally extending rod of the second wire grating to rigidly hold the first wire grating adjacent to the second wire grating; and a support surface positioned adjacent the first wire grating and a wall positioned adjacent the support surface, wherein the second spacer apparatus is positioned on the support surface between the wall and the first wire grating.

19. The system of claim 18 wherein a first longitudinally-extending rod of the first wire grating is disposed on the plurality of ridges of the second spacer apparatus.

20. The system of claim 19 wherein the plurality of ridges of the second spacer apparatus has a wave pattern that matches the wave pattern of the first longitudinally-extending rod of the first wire grating.

* * * * *